US009926151B2

(12) United States Patent
Takahashi et al.

(10) Patent No.: US 9,926,151 B2
(45) Date of Patent: Mar. 27, 2018

(54) SHEET FEEDER AND IMAGE FORMING APPARATUS INCLUDING THE SHEET FEEDER

(71) Applicants: Hideaki Takahashi, Kanagawa (JP); Takashi Fukumoto, Kanagawa (JP); Hidetoshi Kojima, Kanagawa (JP); Tatsuya Sugawara, Kanagawa (JP); Masato Hashimoto, Kanagawa (JP); Takaaki Sanpei, Kanagawa (JP); Kim Foon Lee, Kanagawa (JP)

(72) Inventors: Hideaki Takahashi, Kanagawa (JP); Takashi Fukumoto, Kanagawa (JP); Hidetoshi Kojima, Kanagawa (JP); Tatsuya Sugawara, Kanagawa (JP); Masato Hashimoto, Kanagawa (JP); Takaaki Sanpei, Kanagawa (JP); Kim Foon Lee, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/483,277

(22) Filed: Apr. 10, 2017

(65) Prior Publication Data

US 2017/0327329 A1 Nov. 16, 2017

(30) Foreign Application Priority Data

May 10, 2016 (JP) ..... 2016-094262

(51) Int. Cl.
*B65H 3/48* (2006.01)

(52) U.S. Cl.
CPC ..... *B65H 3/48* (2013.01)

(58) Field of Classification Search
CPC ..... B65H 3/48; B65H 2406/12; B65H 2406/122; B65H 2406/1222; B65H 2406/352

(Continued)

(56) References Cited

U.S. PATENT DOCUMENTS

2005/0040584 A1* 2/2005 Isemura ..... B65H 3/48 271/97
2008/0297580 A1 12/2008 Fukumoto et al.

(Continued)

FOREIGN PATENT DOCUMENTS

JP 07101575 A * 4/1995
JP 2008-222404 9/2008

(Continued)

OTHER PUBLICATIONS

Machine translation of JP 7-101575, retrieved Jul. 20, 2017.*
U.S. Appl. No. 15/364,805, filed Nov. 30, 2016.

*Primary Examiner* — Michael C McCullough
(74) *Attorney, Agent, or Firm* — Harness, Dickey & Pierce, P.L.C.

(57) ABSTRACT

A sheet feeder, which is included in an image forming apparatus, includes a sheet loader, an air blowing device, a regulator, a sheet attracting device, and a sheet conveying body. The sheet loader loads a sheet bundle including a sheet and a subsequent sheet placed below the sheet. The air blowing device blows air and lifts the sheet over the sheet bundle. The regulator regulates movement of the subsequent sheet, and includes an opposing portion located upper end and separated from the sheet loader toward the downstream side of the sheet conveying direction and an inclined portion upwardly inclined relative to a vertical axis from a same position as the sheet loader to the downstream side of the sheet conveying direction. The sheet attracting device attracts the sheet lifted over the sheet bundle. The sheet conveying body conveys the sheet in a sheet conveying direction.

18 Claims, 6 Drawing Sheets

(58) Field of Classification Search
USPC ..... 271/97, 98
See application file for complete search history.

(56) References Cited

U.S. PATENT DOCUMENTS

| | | | |
|---|---|---|---|
| 2009/0014948 | A1 | 1/2009 | Takahashi |
| 2009/0066008 | A1 | 3/2009 | Hirose et al. |
| 2012/0133092 | A1 | 5/2012 | Fuda et al. |
| 2012/0313315 | A1 | 12/2012 | Fukumoto et al. |
| 2014/0339759 | A1 | 11/2014 | Takahashi et al. |
| 2014/0346728 | A1 | 11/2014 | Fuda et al. |
| 2015/0166280 | A1 | 6/2015 | Hino et al. |
| 2015/0225191 | A1 | 8/2015 | Niikura et al. |
| 2016/0016740 | A1 | 1/2016 | Niikura et al. |
| 2016/0107853 | A1 | 4/2016 | Hashimoto et al. |
| 2016/0107854 | A1 | 4/2016 | Hashimoto et al. |
| 2016/0122144 | A1 | 5/2016 | Fukumoto et al. |
| 2016/0264370 | A1 | 9/2016 | Okutsu et al. |

FOREIGN PATENT DOCUMENTS

| | | |
|---|---|---|
| JP | 2009-091074 | 4/2009 |
| JP | 2014-148379 | 8/2014 |
| JP | 2014-152023 | 8/2014 |
| JP | 2014-156310 | 8/2014 |
| JP | 2014-172702 | 9/2014 |
| JP | 2014-172703 | 9/2014 |
| JP | 2015-009926 | 1/2015 |
| JP | 2015-110464 | 6/2015 |
| JP | 2016-079013 | 5/2016 |
| JP | 2016-124707 | 7/2016 |

* cited by examiner

SHEET FEEDER AND IMAGE FORMING APPARATUS INCLUDING THE SHEET FEEDER

CROSS-REFERENCE TO RELATED APPLICATION

This patent application is based on and claims priority pursuant to 35 U.S.C. § 119(a) to Japanese Patent Application No. 2016-094262, filed on May 10, 2016, in the Japan Patent Office, the entire disclosure of which is hereby incorporated by reference herein.

BACKGROUND

Technical Field

This disclosure relates to a sheet feeder that feeds a sheet such as a transfer sheet, a paper and a recording sheet, and an image forming apparatus such as a copier, printer, facsimile machine, printing machine, and a multifunctional apparatus including at least two functions of the copier, printer, facsimile machine, and printing machine.

Related Art

Various image forming apparatuses such as copiers, printers, and printing machines include a sheet feeder that feeds sheets such as transfer sheets. Such a sheet feeder that can be included in an image forming apparatus is known to employ an air adsorption method using an air blowing device. For example, by performing the air adsorption method in the above-described sheet feeder, air is blown from the air blowing device toward an uppermost sheet of a sheet bundle loaded on a sheet loading member. The uppermost sheet blown by the air blowing device is lifted and attracted to a sheet attracting device. While the uppermost sheet is being attracted by the sheet attracting device, a sheet conveying belt conveys the uppermost sheet in a sheet conveying direction.

To be specific, a known sheet feeder includes a sheet loading member (a bottom plate), a regulating member (a sheet blocking member), an air blowing device, a sheet conveying belt (a sheet attraction belt), and so forth.

Of sheets of the sheet bundle loaded on the sheet loading member, the uppermost sheet is lifted over the sheet bundle and is drawn by the sheet attracting device while the air blowing device is blowing air to an end face of the uppermost sheet. By so doing, the uppermost sheet is attracted to the sheet conveying belt. As the sheet conveying belt rotates, the uppermost sheet attracted to the sheet conveying belt is conveyed in the sheet conveying direction.

Here, a sheet blocking member having a substantially plate shape is disposed above an inner wall face (a reference plane) disposed at a downstream side in the sheet conveying direction of the sheet loader. The sheet blocking member stands upward in a vertical direction toward an upper side of the sheet feeder. This sheet blocking member is provided to regulate movement of a subsequent sheet to the uppermost sheet lifted by the air blowing device in the sheet conveying direction.

By contrast, another known sheet feeder discloses a technique with a configuration, in which an air blowing device includes an air outlet (an opening) from which air is blown to an uppermost sheet of multiple sheets loaded on a sheet loading member and a shutter plate to open and close the air outlet. In the air blowing device, both the air outlet feeder and the shutter plate are disposed inclined relative to a vertical direction.

In the first one of the above-described sheet feeders, a sheet loaded on the sheet loading member may have a curl or curls at the leading end or the trailing end, for example, in an upwardly curled shape, in a sheet conveying direction. When the uppermost sheet having a curl or curls is lifted and attracted to the sheet conveying belt, the uppermost sheet is caught by the regulating member (i.e., the sheet blocking member), which may lead to paper jam, for example.

By contrast, the second one of the above-described sheet feeders discloses a technique in which the regulating member (i.e., the sheet blocking member) is inclined relative to the vertical direction. However, if a subsequent sheet below the uppermost sheet is also lifted and conveyed together with the uppermost sheet by the sheet transfer belt, multi-feeding failure may occur.

SUMMARY

At least one aspect of this disclosure provides a sheet feeder including a sheet loader, an air blowing device, a regulator, a sheet attracting device, and a sheet conveying body. The includes an inner wall face standing upward at a downstream side of a sheet conveying direction, on which a sheet bundle is loaded. The air blowing device includes a first air blowing body disposed downstream from the sheet loader in the sheet conveying direction. The air blowing device is configured to blow air toward the sheet bundle loaded on the sheet loader and lift a sheet over the sheet bundle. The regulator is mounted on the inner wall face of the sheet loader and is configured to regulate movement of a subsequent sheet located below the sheet lifted over the sheet bundle. The sheet attracting device is disposed above the sheet loader. The sheet attracting device is configured to attract the sheet lifted over the sheet bundle by the air blowing device. The sheet conveying body is disposed in contact with the sheet attracting device and is configured to convey the sheet in the sheet conveying direction with the sheet attached thereto. The regulator includes an opposing portion located at an upper end of the regulator and separated from the inner wall face toward the downstream side of the sheet conveying direction, and an inclined portion upwardly inclined relative to a vertical axis from a same position as the inner wall face to the downstream side of the sheet conveying direction.

Further, at least one aspect of this disclosure provides an image forming apparatus including the above-described sheet feeder configured to feed the sheet, and an image forming device configured to form an image on the sheet fed from the sheet feeder.

DETAILED DESCRIPTION

Figure 1:
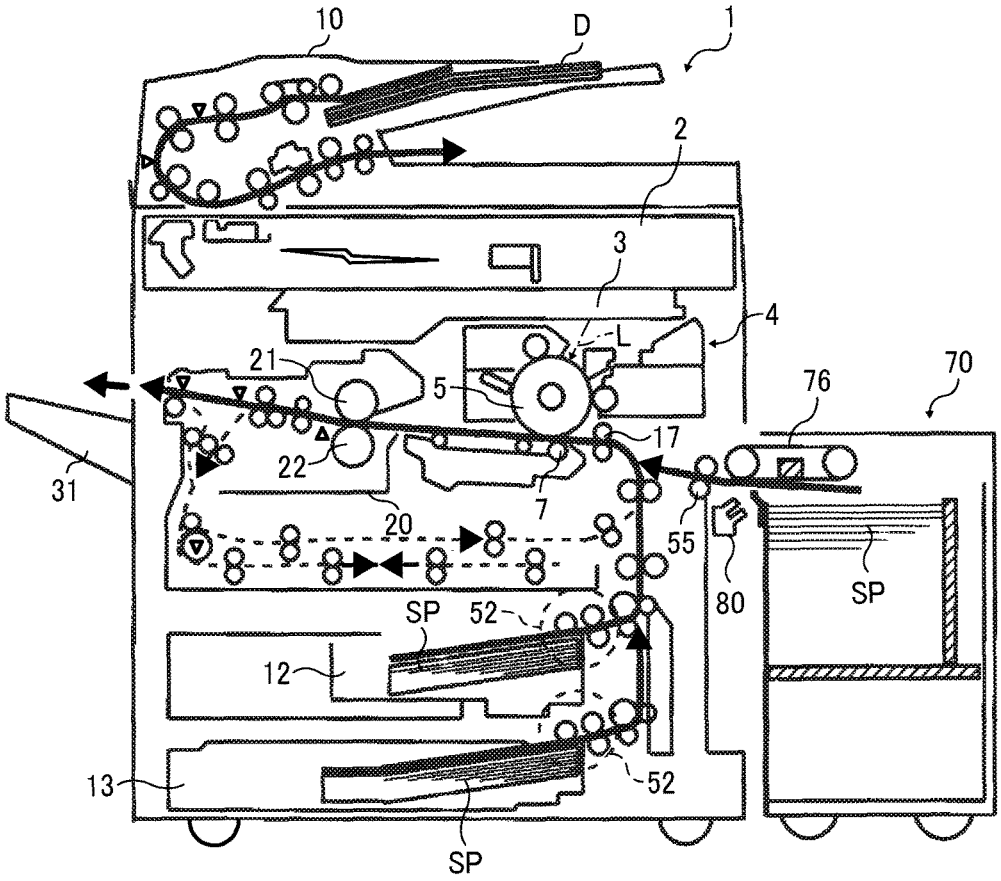
FIG. 1 is a diagram illustrating an overall configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a configuration and functions of an image forming apparatus 1 according to an embodiment of this disclosure, with reference to drawings.

It is to be noted that identical parts are given identical reference numerals and redundant descriptions are summarized or omitted accordingly.

Now, a description is given of a basic configuration and functions of the image forming apparatus 1 with reference to FIG. 1.

FIG. 1 is a diagram illustrating an overall configuration of the image forming apparatus 1 according to an embodiment of this disclosure.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying passage to a downstream side thereof; the term "width direction" indicates a direction basically perpendicular to the sheet conveying direction.

In FIG. 1, the image forming apparatus 1 includes a document reading device 2, an exposure device 3, an image forming device 4, a photoconductor drum 5, a transfer roller 7, a document conveying unit 10, a first sheet feed tray 12, a second sheet feed tray 13, a pair of registration rollers 17, a fixing device 20, a fixing roller 21, a pressure roller 22, a sheet output tray 31, and a sheet feeding device 70.

The document reading device 2 optically reads image data of an original document D.

The exposure device 3 emits an exposure light L recording medium P the image data read by the document reading device 2 to irradiate the exposure light L on a surface of the photoconductor drum 5 that functions as an image bearer.

The image forming device 4 forms a toner image on the surface of the photoconductor drum 5.

The photoconductor drum 5 that functions as an image bearer and the transfer roller 7 that functions as a transfer body are included in the image forming device 4.

The transfer roller 7 transfers the toner image formed on the surface of the photoconductor drum 5 onto a sheet SP.

The document conveying unit 10 functions as a document feeder that conveys the original document D set on a document tray or a document loader to the document reading device 2.

Each of the first sheet feed tray 12 and the second sheet feed tray 13 accommodates the sheet SP such as a transfer sheet therein.

The pair of registration rollers 17 functions as a pair of timing rollers that conveys the sheet SP toward the transfer roller 7.

The fixing device 20 includes the fixing roller 21 and the pressure roller 22 to fuse an unfixed image formed on the sheet SP to the sheet SP by application of heat and pressure. The sheet output tray 31 receives the sheet SP output from an apparatus body of the image forming apparatus 1.

The sheet feeding device 70 is a large capacity sheet feeding device that accommodates a large amount of sheets SP therein.

Now, a description is given of regular image forming operations performed by the image forming apparatus 1, with reference to FIG. 1.

The original document D is fed from a document loading table provided to the document conveying unit 10 and conveyed by multiple pairs of sheet conveying rollers disposed in the document conveying unit 10 in a direction indicated by arrow in FIG. 1 over the document reading device 2. At this time, the document reading device 2 optically reads image data of the original document D passing over the document reading device 2.

Consequently, the image data optically scanned by the document reading device 2 is converted to electrical signals. The converted electrical signals are transmitted to the exposure device 3 by which the image is optically written. Then, the exposure device 3 emits exposure light (laser light) L based on the image data of the electrical signals toward the surface of the photoconductor drum 5 of the image forming device 4.

By contrast, the photoconductor drum 5 of the image forming device 4 rotates in a clockwise direction in FIG. 1.

After a series of predetermined image forming processes, e.g., a charging process, an exposing process, and a developing process, a toner image corresponding to the image data is formed on the surface of the photoconductor drum 5.

Thereafter, the toner image formed on the surface of the photoconductor drum 5 is transferred by the transfer roller 7, at the transfer nip region in the image forming device 4 where the transfer roller 7 and the photoconductor drum 5 contact to each other, onto the sheet SP conveyed by the pair of registration rollers 17.

By contrast, the sheet SP that is conveyed to the transfer roller 7 is handled as described below.

As illustrated in FIG. 1, one of the first sheet feed tray 12 and the second sheet feed tray 13 of the image forming apparatus 1 is selected automatically or manually. In the operations according to the present embodiment of this disclosure, the first sheet feed tray 12 that is an upper sheet tray is selected, for example. It is to be noted that the first sheet feed tray 12 and the second sheet feed tray 13 basically have an identical configuration to each other. Consequently, when the first sheet feed tray 12 of the image forming apparatus 1 is selected, an uppermost sheet SP1 accommodated in the first sheet feed tray 12 is fed by a sheet feeding mechanism 52 toward a sheet conveying passage. The sheet feeding mechanism 52 includes a sheet feed roller, a pickup roller, a backup roller, and so forth. Thereafter, the sheet SP passes through the sheet conveying passage in which multiple sheet conveying rollers are disposed, and reaches the pair of registration rollers 17.

It is to be noted that, when the sheet feeding device 70 that contains a large capacity of sheets (that is, a large capacity sheet feeding device) disposed at one side of the apparatus body of the image forming apparatus 1 is selected, an uppermost sheet SP1 placed on a sheet bundle SB including multiple sheets loaded on a sheet loader 72 (see FIG. 2) of the sheet feeding device 70 is fed by a conveying belt **76*a* of a sheet conveying device 76 into the sheet conveying passage where a pair of sheet feed rollers 55 is disposed, eventually reaching the pair of registration rollers 17**.

After reaching the pair of registration rollers 17, the uppermost sheet SP1 is then conveyed toward the transfer roller 7 in synchronization with movement of the toner image formed on the surface of the photoconductor drum 5 for positioning.

After completion of the transferring process, the sheet SP passes the transfer roller 7 and reaches the fixing device 20 via the sheet conveying passage. In the fixing device 20, the sheet SP is conveyed between the fixing roller 21 and the pressure roller 22, so that the toner image is fixed to the sheet SP by application of heat applied by the fixing roller 21 and pressure applied by the fixing roller 21 and the pressure roller 22, which is a fixing process. The sheet SP with the toner fixed thereto after the fixing process passes a fixing nip region formed between the fixing roller 21 and the pressure roller 22. Then, the sheet SP exits from the image forming apparatus 1. After having been output from the image forming apparatus 1, the sheet SP is stacked as an output image on the sheet output tray 31.

Accordingly, a series of image forming processes is completed.

Next, a detailed description is given of the sheet feeding device 70 (that is, a large capacity sheet feeding device) according to an embodiment of this disclosure, with reference to FIGS. 2 through 6.

Figure 2:
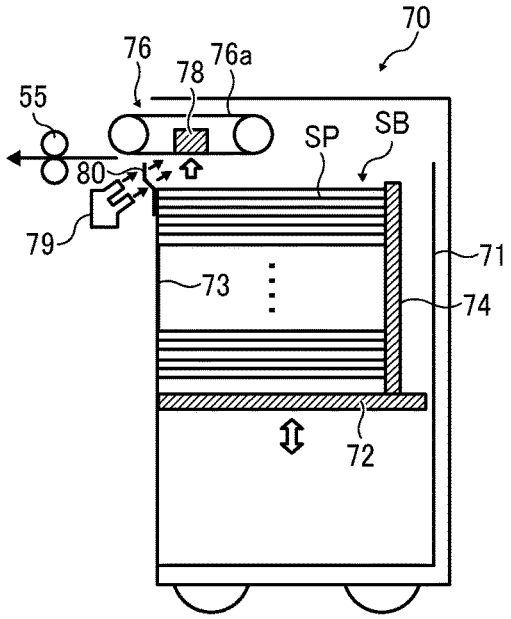
FIG. 2 is a drawing illustrating a schematic configuration of a sheet feeding device according to an embodiment of this disclosure.
Figure 3:
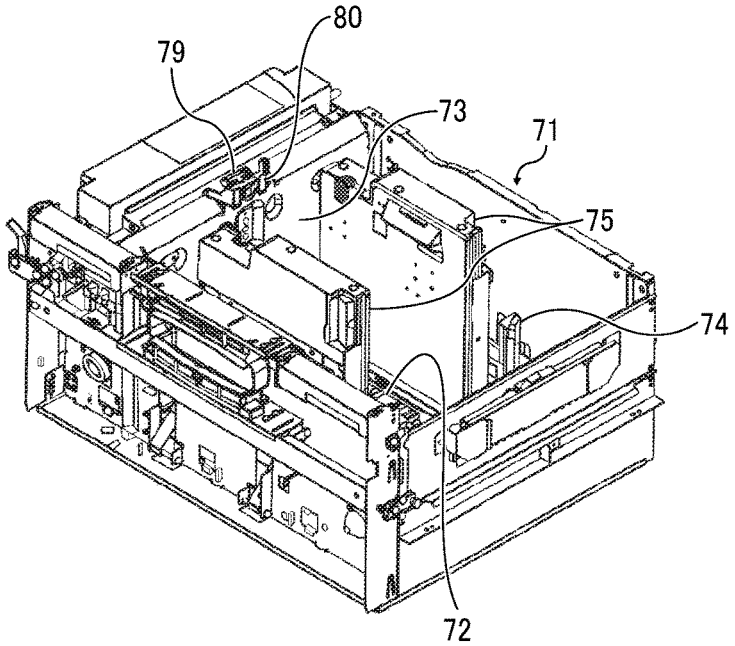
FIG. 3 is a perspective view illustrating an interior of the sheet feeding device with a sheet conveying device removed.
Figure 4:
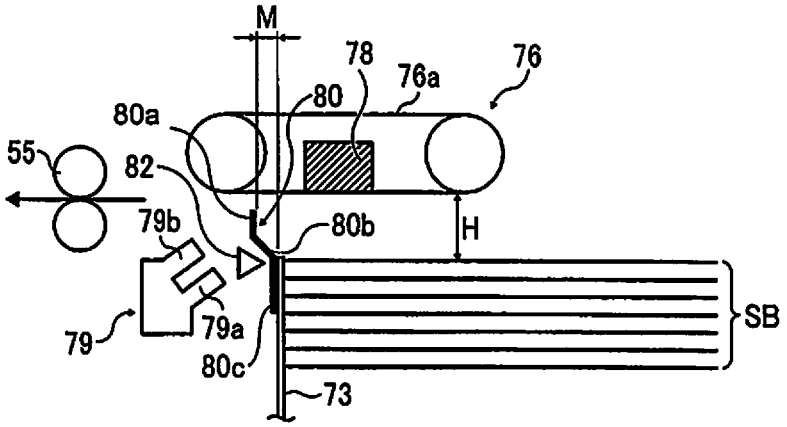
FIG. 4 is an enlarged view illustrating the sheet feeding device.
Figure 5:
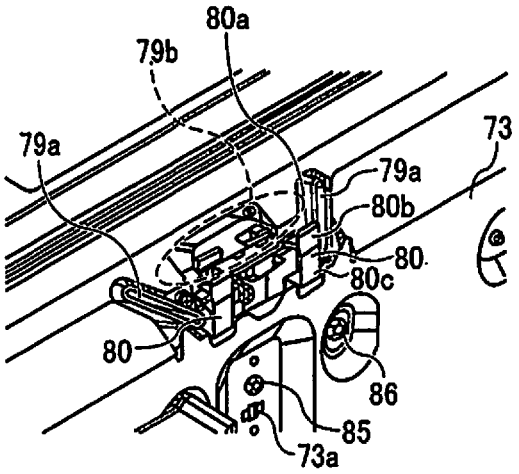
FIG. 5 is a perspective view illustrating a regulating plate and parts disposed near the regulating plate.

FIG. 2 is a drawing illustrating a schematic configuration of the sheet feeding device 70 according to an embodiment of this disclosure. FIG. 3 is a perspective view illustrating an interior of the sheet feeding device 70 with the sheet conveying device 76 removed. FIG. 4 is an enlarged view illustrating the sheet feeding device 70. FIG. 5 is a perspective view illustrating a regulating plate 80 and parts disposed near the regulating plate 80. FIGS. 6A, 6B, 6C, and 6D are diagrams illustrating steps of a sheet feeding operation of the sheet feeding device 70.

Referring to FIGS. 2 through 4, the sheet feeding device 70 is to feed the sheet SP in a predetermined sheet conveying direction, as indicated by arrow in FIG. 2, and includes a sheet container 71, a sheet conveying device 76, an air blowing device 79, and so forth.

The sheet container 71 includes the sheet loader 72 (a lift tray), a reference plane 73 (a reference fence), an end fence 74, a pair of side fences 75, a regulating plate 80 that functions as a regulator, a height detection sensor 82, and so forth.

The sheet conveying device 76 includes the conveying belt 76*a* and an air drawing device 78 (a belt attraction device). The conveying belt 76*a* is wound around and stretched by two rollers.

With this configuration, the sheet SP contained in the sheet container 71 is fed by the sheet conveying device 76 in the sheet conveying direction indicated by arrow in FIGS. 2 and 4.

To be more specific, the reference plane 73 functions as an inner wall of the reference fence formed so as to stand in a vertical direction upwardly at a downstream side of the sheet loader 72 of the sheet container 71 in the sheet conveying direction.

The sheet loader 72 loads multiple sheets SP in a state in which the multiple sheets SP remain in contact with the reference plane 73. Further, the sheet loader 72 is vertically movable such that an uppermost sheet SP1 is located at a predetermined position in height even though the number of sheets SP loaded on the sheet loader 72 varies. The predetermined position in height of the uppermost sheet SP1 corresponds to the position depicted in FIG. 4 and is detected by the height detection sensor 82. That is, the sheet loader 72 loads multiple sheets SP and elevates in the vertical direction indicated by white arrow in FIG. 2, operated by a loader elevation device according to the number of sheets loaded (left) thereon. The loader elevation device that causes the sheet loader 72 to elevate or vertically move can employ a known technique.

It is to be noted that the height detection sensor 82 is located at a predetermined setting position that is a position in the vertical direction and separated by a distance H from the conveying belt 76*a* illustrated in FIG. 4. The setting position of the height detection sensor 82 is determined based on a withdrawing performance by the air blowing device 79 and an air drawing performance by the air drawing device 78 such that the conveying belt 76*a* can attract by air and convey the uppermost sheet SP1. In the present embodiment of this disclosure, the height detection sensor 82 is a reflection type photosensor that can be disposed facing a sheet SP (i.e., the sheet SP accommodated in the sheet container 71) via a light transmitting portion (e.g., a window) formed in the reference plane 73 (i.e., the reference fence).

As illustrated in FIGS. 2 and 3, the end fence 74 is movable manually (or automatically) in an interval between the end fence 74 and the reference plane 73 in the sheet conveying direction (in a left-and-right direction in FIG. 2) according to the size of the sheet SP in the sheet conveying direction.

In reference to FIG. 3, the pair of side fences 75 is movable manually (or automatically) in a width direction of the sheet SP (that is a direction perpendicular to the sheet conveying direction and vertical to the drawing sheet) according to the size of the sheet SP in the width direction.

After the sheet SP (the sheet bundle SB) has been loaded on the sheet loader 72 by abutting against the reference plane 73, the pair of side fences 75 and the end fence 74 are moved to abut against the sheet bundle SB loaded on the sheet loader 72. By so doing, the setting of the sheet SP (the sheet bundle SB) in the sheet container 71 is completed.

It is to be noted that the sheet container 71 includes the regulating plate 80 that functions as a regulator mounted on the reference plane 73 (the reference fence). A detailed description of this configuration is given below.

As illustrated in FIGS. 2 and 4, the air blowing device 79 is disposed downstream (on the left side of FIGS. 2 and 4). The air blowing device 79 blows air toward the uppermost sheet SP1 placed on top of the sheet bundle SB loaded on the sheet loader 72, so as to lift and float the uppermost sheet SP1, as illustrated in FIG. 6B.

To be more specific, the air blowing device 79 includes an air blowing fan, an air duct, a first air blowing nozzle 79*a*, a second air blowing nozzle 79*b*, and shutters to respectively open and close the first air blowing nozzle 79*a* and the second air blowing nozzle 79*b*. With this configuration, air drawn by the air blowing fan is blown from the first air blowing nozzle 79*a* via the air duct. The air is then blown to the uppermost sheet SP1 (and a subsequent sheet SP2 that lies below the uppermost sheet SP1 in the sheet bundle SB). Consequently, the uppermost sheet SP1 is separated from the sheet bundle SB due to positive air pressure, resulting in upward elevation of the uppermost sheet SP1. Since the air drawing device 78 draws air above the sheet bundle SB, the uppermost sheet SP1 is encouraged to be attracted to the conveying belt 76*a*.

It is to be noted that a timing at which the air blowing device 79 blows air through the first air blowing nozzle 79*a* toward the uppermost sheet SP1 is preferably at the same time as or earlier than a timing at which the air drawing device 78 starts an air drawing operation.

Here, the sheet feeding device 70 according to the present embodiment of this disclosure further includes a second air blowing device that is disposed downstream from the sheet loader 72 (the sheet container 71) in the sheet conveying direction. The second air blowing device blows air between the uppermost sheet SP1 lifted by the air blowing device 79 (via the first air blowing nozzle 79*a*) and the subsequent sheet SP2, so as to separate the subsequent sheet SP2 from the uppermost sheet SP1.

In the present embodiment of this disclosure, the air blowing device 79 that includes the first air blowing nozzle 79*a* also functions as the above-described second air blowing device. To be more specific, the air blowing device 79 includes a first shutter to open and close the first air blowing nozzle 79*a* and a second shutter to open and close the second air blowing nozzle 79*b*. By controlling the opening and closing of the first shutter and the second shutter, the air blowing device 79 functions as an air blowing device (specifically, a first air blowing device) that blows air to the uppermost sheet SP1 to lift, as illustrated in FIG. 6B, when the first air blowing nozzle 79*a* is opened and the second air blowing nozzle 79*b* is closed. By contrast, the air blowing device 79 functions as a second air blowing device that blows air between the uppermost sheet SP1 and the subsequent sheet SP2 to separate the subsequent sheet SP2 form the uppermost sheet SP1, as illustrated in FIG. 6C, when the first air blowing nozzle 79*a* is closed and the second air blowing nozzle 79*b* is opened.

It is to be noted that the first air blowing device and the second air blowing device are integrally formed as the air blowing device 79 as a single unit in the present embodiment of this disclosure but the configuration of the air blowing device is not limited thereto. For example, the first air blowing device and the second air blowing device may be provided separately.

As illustrated in FIGS. 2 and 4, the air drawing device 78 is disposed above the sheet loader 72 (the sheet container 71). The air drawing device 78 attracts the uppermost sheet SP1 that is lifted by the air blowing device 79 (specifically, by air blown from the first air blowing nozzle 79*a*). In other words, the air drawing device 78 generates negative air pressure above the sheet bundle SB loaded on the sheet loader 72 so as to attract the uppermost sheet SP1.

To be more specific, the air drawing device 78 includes an air drawing fan, an air drawing duct, an air drawing chamber, and so forth. The air drawing chamber is disposed in a loop of the conveying belt 76*a* and has an opening formed in a bottom portion thereof. The air drawing chamber communicates through the opening with a spaced portion below via multiple small diameter openings formed in the conveying belt 76*a*. At least one of the multiple small diameter openings of the conveying belt 76*a*, formed at one end side in the width direction of the air drawing chamber is connected to the air drawing fan via the air drawing duct. Then, as the air drawing fan is driven, air is drawn from the bottom portion of the conveying belt 76*a* as indicated by the white arrow in FIG. 2.

Referring to FIGS. 2 and 4, the conveying belt 76*a* conveys the uppermost sheet SP1 in the sheet conveying direction in a state in which the uppermost sheet SP1 remains in contact with the air drawing device 78 due to attraction by air.

To be more specific, the conveying belt 76*a* is disposed to extend over an outlet port of the sheet feeding device 70 at the extreme downstream side in the sheet conveying direction above the sheet container 71. The conveying belt 76*a* is stretched and supported by two rollers. As one of the rollers is driven by a drive motor, the conveying belt 76*a* is rotated in a clockwise direction as illustrated in FIG. 2. As described above, the conveying belt 76*a* has the multiple small diameter openings over the whole surface thereof.

As illustrated in FIGS. 2 through 6D, the sheet feeding device 70 according to the present embodiment of this disclosure includes the regulating plate 80 that functions as a regulator that stands upwardly from the reference plane 73. The regulating plate 80 functions as a regulator to regulate movement of the subsequent sheet SP2 in the sheet conveying direction, the subsequent sheet SP2 being placed below the uppermost sheet SP1 lifted by (the air blown from the first air blowing nozzle 79*a* of) the air blowing device 79. That is, the regulating plate 80 (i.e., a regulator) prevents misfeed (multifeed) of sheets in which the subsequent sheet SP2 that is not supposed to be attracted and conveyed by the conveying belt 76*a* is fed and conveyed together with the uppermost sheet SP1 that is supposed to be attracted and conveyed by the conveying belt 76*a*. Specifically, when the subsequent sheet SP2 is about to be fed together with the uppermost sheet SP1, the subsequent sheet SP2 is interfered by the regulating plate 80, so that the movement (conveyance) of the subsequent sheet SP2 is regulated.

Now, as illustrated in FIGS. 4 and 5, the regulating plate 80 (i.e., a regulator) has opposing faces, each disposed facing the sheet SP (i.e., the uppermost sheet SP1) lifted by the air blowing device 79. Specifically, the opposing faces are disposed facing the sheet container 71.

The opposing faces of the regulating plate 80 includes a first vertical opposing face 80*a* that functions as a first opposing portion, an inclined opposing face 80*b* that functions as an inclined portion, and a second vertical opposing face 80*c* that functions as a second opposing portion.

The first vertical opposing face 80*a* (i.e., the vertical opposing portion) is disposed to stand in a substantially vertical direction at an upper end side of the regulating plate 80 (i.e., the regulator) such that the first vertical opposing face 80*a* is separated from the reference plane 73 toward a downstream side of the sheet conveying direction. That is, the first vertical opposing face 80*a* is located at a position shifted to the left side in FIG. 4 by a distance M relative to the reference plane 73.

It is to be noted that the distance M is determined according to a trajectory (movement) of the leading end of the uppermost sheet SP1 such that the leading end of the uppermost sheet SP1 lifted by the air blowing device 79 in a curled condition is not interfered when the uppermost sheet SP1 is attracted and conveyed by the conveying belt 76*a* (and the air drawing device 78). The distance M is preferably a requisite minimum distance or a relatively short distance, so as to reduce the size of the regulating plate 80, and consequently the size of the sheet feeding device 70.

The inclined opposing face 80*b* is formed to downwardly incline relative to the vertical direction (a vertical axis), extending from a lower end of the first vertical opposing face 80*a* and gradually approaching the reference plane 73 to reach the substantially same position as the reference plane 73. In other words, the inclined opposing face 80*b* is upwardly inclined relative to the vertical direction from a substantially same position as the reference plane 73 to the downstream side of the sheet conveying direction. That is, the upper end of the inclined opposing face 80*b* is located at a position shifted to the left side in FIG. 4 by the distance M relative to the reference plane 73, and the lower end of the inclined opposing face 80*b* is located at a position in the vicinity of the upper end of the reference plane 73, inclined from the upper end to the lower end to an obliquely right side in FIG. 4.

It is to be noted that the inclination expressed here relates to a linear or straight inclination and to a curved inclination such as a warp shaped inclination and a bow shaped inclination. That is, the inclined opposing face 80*b* includes any portion as long as the distance M separating from the reference plane 73 continuously and gradually increases upwardly.

Further, an angle of inclination of the inclined opposing face 80*b* (i.e., an angle of the inclined opposing face 80*b* relative to the reference plane 73 in FIG. 4) is set to be an acute angle, for example, an angle of 30 to 60 degrees in the present embodiment of this disclosure.

The second vertical opposing face 80*c* is disposed to stand in the substantially vertical direction (a vertical axis), extending downwardly from the lower end of the inclined opposing face 80*b* to remain at the substantially same position as the reference plane 73. That is, the second vertical opposing face 80*c* is formed to extend along with the reference plane 73 (the reference fence). To be more specific, as illustrated in FIG. 5, the second vertical opposing face 80*c* is formed to extend along the substantially same face as the reference plane 73.

Figure 6A:
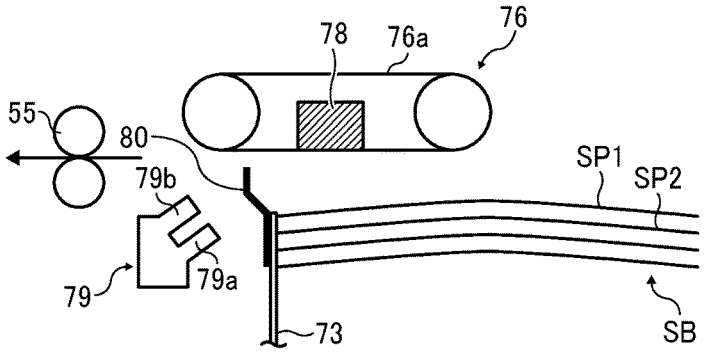
FIGS. 6A, 6B, 6C, and 6D are diagrams illustrating steps of a sheet feeding operation of the sheet feeding device.
Figure 6B:
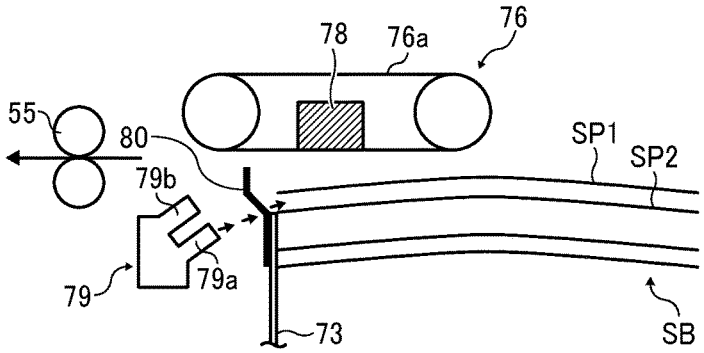
Figure 6C:
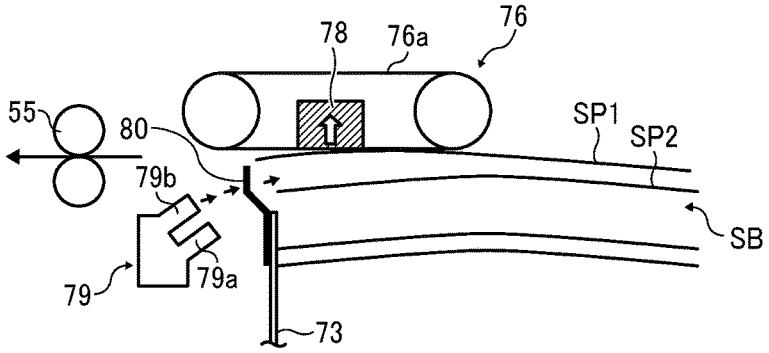

When a sheet SP of the sheet bundle SB loaded on the sheet loader 72 is curled (that is, warped upwardly to a bow shape) as illustrated in FIG. 6A, it is likely that the uppermost sheet SP1 lifted by air from the air blowing device 79 and attracted by the air drawing device 78 is caught by the regulating plate 80 during conveyance, resulting in a sheet conveying failure such as paper jam. However, according to the configuration including the regulating plate 80 (i.e., the regulator) as described above, even when the uppermost sheet SP1 in the curled condition is conveyed by the conveying belt 76*a* while the uppermost sheet SP1 is being lifted by air blown from the first air blowing nozzle 79*a* of the air blowing device 79 and attracted by the air drawing device 78, occurrence of the sheet conveying failure can be reduced reliably.

Figure 7:
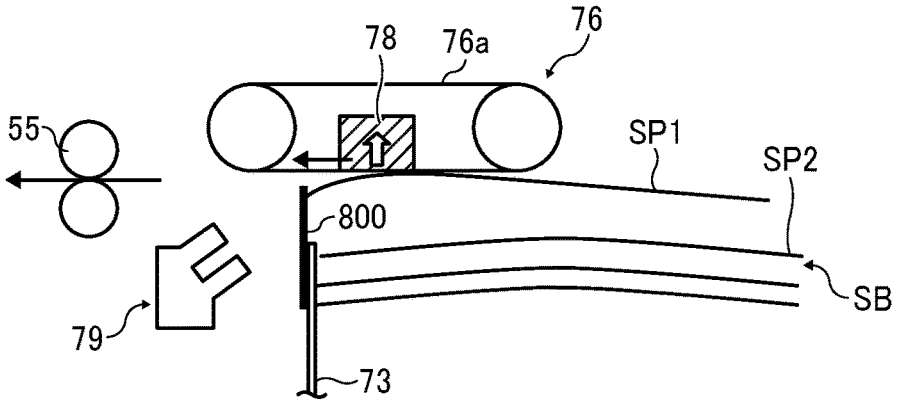
FIG. 7 is an enlarged view illustrating a main part of a comparative sheet feeding device.

For example, FIG. 7 is an enlarged view illustrating a main part of a comparative sheet feeding device. As illustrated in FIG. 7, the comparative sheet feeding device includes a regulating plate 800. In a case in which the regulating plate 800 that is formed to extend along the reference plane 73 from the upper end to the lower end is employed, as illustrated in FIG. 7, the leading end of the uppermost sheet SP1 in a curled condition is caught by the regulating plate 800 when the uppermost sheet SP1 is attracted and conveyed by the conveying belt 76*a*, and therefore a sheet conveying failure occurs.

For example, a sheet or sheets loaded on a sheet loading member in a comparative sheet feeding device may be in a back-edge curl condition, in which the edge of a sheet remains upwardly warped in a convex manner in a sheet conveying direction. Under the back-edge curl condition, an uppermost sheet of the sheets loaded on the sheet loading member may be conveyed by a sheet conveying belt in the sheet conveying direction while the uppermost sheet is lifted by air blown by an air blowing device and attracted by an sheet attracting device. At this time, it is likely that the uppermost sheet is caught by a regulating member (e.g., a sheet blocking member), and this may cause a sheet conveyance failure such as paper jam.

By contrast, a technique disclosed in another comparative sheet feeding device is employed to further cause the regulating member (e.g., the sheet blocking member) to be inclined relative to a vertical direction. In this case, however, it is likely that a subsequent sheet below the uppermost sheet to be regulated by the regulating member is also conveyed together with the uppermost sheet by the sheet conveying belt, and therefore a multi feeding failure occurs.

By contrast, in the configuration including the regulating plate 80 according to the present embodiment of this disclosure, the upper end of the regulating plate 80 (i.e., the first vertical opposing face 80*a*) is formed to be shifted toward the downstream side of the sheet conveying direction and the inclined opposing face 80*b* is formed to gradually incline from the reference plane 73 toward the upper end of the regulating plate 80 (i.e., the first vertical opposing face 80*a*). Therefore, even when the uppermost sheet SP1 is curled to a downward bow shape, the leading end of the uppermost sheet SP1 is not interfered by the regulating plate 80 easily in a series of processes in which the uppermost sheet SP1 is lifted by the air blowing device 79, attracted by the air drawing device 78, and conveyed by the conveying belt 76*a*. Accordingly, the sheet conveying failure in which the uppermost sheet SP1 is caught by the regulating plate 80 to cause a paper jam can be reduced reliably.

Further, the regulating plate 80 includes not only the inclined opposing face 80*b* from the lower end to the upper end, but also the first vertical opposing face 80*a* disposed at the upper end. Therefore, occurrence of the sheet conveying failure such as multifeed in which the subsequent sheet SP2 is conveyed together with the uppermost sheet SP1 by the conveying belt 76*a* is reduced reliably. Specifically, when the uppermost sheet SP1 is attracted and conveyed by the conveying belt 76*a*, the subsequent sheet SP2 is caught by the first vertical opposing face 80*a*, and therefore the sheet conveyance (i.e., multifeed) is restrained.

It is to be noted that, in the present embodiment of this disclosure, the lower end of the inclined opposing face 80*b* (or the upper end of the second vertical opposing face 80*c*) is set to a position substantially same as the predetermined position in height, which is a position in the vertical direction, detected by the height detection sensor 82 and separated from the conveying belt 76*a* by the distance H.

With this configuration, the above-described regulating plate 80 can deliver the performance more easily.

Further, in the present embodiment of this disclosure, the position in the vertical direction of the regulating plate 80 (i.e., the regulator) is manually adjustable.

To be more specific, as illustrated in FIG. 5, the regulating plate 80 is secured to the regulating plate 80 (i.e., the reference fence) with screws 85 and 86, so as to determine the position in height. By loosening the screws 85 and 86, the regulating plate 80 is movable in the vertical direction relative to the reference plane 73 (i.e., the reference fence). Specifically, the reference plane 73 (i.e., the reference fence) has slots extending in the vertical direction. The screws 85 and 86 go through the respective slots of the reference plane 73. Further, the reference plane 73 has a scale 73*a* to recognize an adjustment position in height of the regulating plate 80.

By permitting fine adjustment of the position of the regulating plate 80 in height, even when a series of processes of elevation, attraction, and conveyance of the uppermost sheet SP1 or the subsequent sheet SP2 changes due to various reasons such as dimensional accuracy and assembling accuracy of various parts and components, the regulating plate 80 can be arranged and located at a position applicable to the change. Further, even when the series of processes of elevation, attraction, and conveyance of the uppermost sheet SP1 or the changes due to different types, thicknesses, and sizes of the sheet SP placed on the sheet loader 72, the regulating plate 80 can also be arranged and located at a position applicable to the change.

Next, a description is given of the steps of the sheet feeding operation according to the present embodiment of this disclosure, with reference to FIGS. 6A through 6D.

As illustrated in FIG. 6A, the uppermost sheet SP1 and the subsequent sheet SP2 are set on the sheet loader 72 of the sheet container 71 in a curled condition.

As a print key provided on the apparatus body of the image forming apparatus 1, the first air blowing nozzle 79*a* of the air blowing device 79 blows air toward the uppermost sheet SP1, so that the uppermost sheet SP1 is lifted toward the sheet conveying device 76, as illustrated in FIG. 6B. At the substantially same time, the air drawing device 78 starts the air drawing operation, and therefore the uppermost sheet SP1 is attracted to the conveying belt 76*a*, as illustrated in FIG. 6C. At this time, even when the uppermost sheet SP1 that is floating over the sheet bundle SB is in the curled condition, the inclined opposing face 80*b* of the regulating plate 80 prevents the leading end of the uppermost sheet SP1 from interfering with the regulating plate 80. It is to be noted that, when the air blowing device 79 blows air to the uppermost sheet SP1 in a state illustrated in FIG. 6B, the subsequent sheet SP2 is lifted together with the uppermost sheet SP1.

Thereafter, as illustrated in FIG. 6C, the second air blowing nozzle 79*b* of the air blowing device 79 blows air toward the uppermost sheet SP1 and the subsequent sheet SP2. The air blown from the second air blowing nozzle 79*b* of the air blowing device 79 separates the subsequent sheet SP2 from the uppermost sheet SP1, and the subsequent sheet SP2 separated from the uppermost sheet SP1 falls onto the sheet loader 72.

Figure 6D:
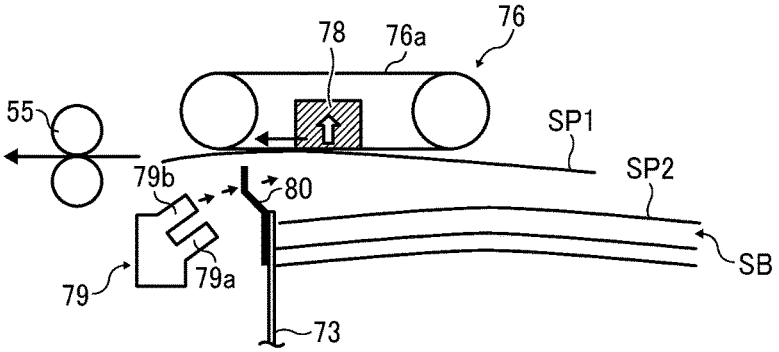

Then, as illustrated in FIG. 6D, the conveying belt 76*a* starts rotating in a direction indicated by arrow depicted in the loop of the conveying belt 76*a* in FIG. 6D. With this rotation of the conveying belt 76*a*, the uppermost sheet SP1 attracted to the conveying belt 76*a* is conveyed toward the pair of sheet feed rollers 55. At this time, even when the uppermost sheet SP1 to be conveyed is in the curled condition of a downward bow shape, the inclined opposing face 80*b* of the regulating plate 80 prevents the downwardly curling leading end of the uppermost sheet SP1 from interfering with the regulating plate 80 and the subsequent sheet SP2 from being conveyed together with the uppermost sheet SP1. According to this configuration, the sheet feed failure such as a paper jam and a multifeed error does not occur.

Then, the uppermost sheet SP1 is conveyed in the sheet conveying direction as indicated by arrow at the pair of sheet feed rollers 55 in FIG. 6D. After a trailing end of the uppermost sheet SP1 has passed below the air drawing device 78, the subsequent sheet SP2 turns to another uppermost sheet SP1, and the steps of the sheet feeding operation illustrated in FIGS. 6B through 6D are repeated.

Variation 1.

Figure 8:
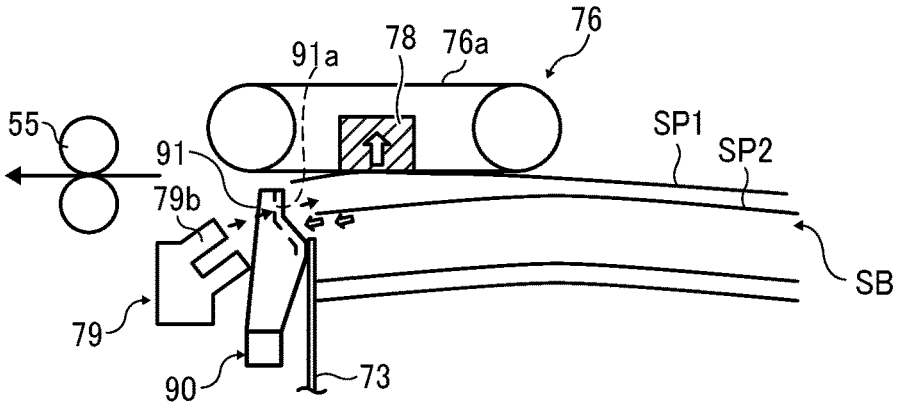
FIG. 8 is a drawing illustrating a main part of the sheet feeding device according to Variation 1.
Figure 9:
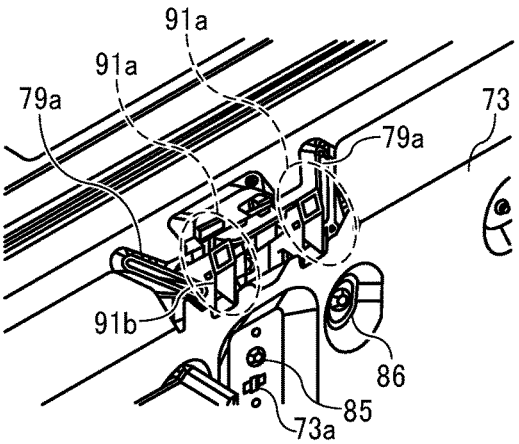
FIG. 9 is an enlarged and perspective view illustrating the regulating plate and the parts near the regulating plate in the sheet feeding device of FIG. 8.

FIG. 8 is a drawing illustrating a main part of the sheet feeding device 70 according to Variation 1. FIG. 8 is modified based on the sheet feeding operation illustrated in FIG. 6C. FIG. 9 is an enlarged and perspective view illustrating the regulating plate 80 and the parts near the regulating plate 80 in the sheet feeding device 70 of FIG. 8. FIG. 9 is modified based on the configuration illustrated in FIG. 5.

As illustrated in FIGS. 8 and 9, the sheet feeding device 70 in Variation 1 includes a second air drawing device 90 that is disposed downstream from the sheet loader 72 (the sheet container 71) in the sheet conveying direction. The second air drawing device 90 functions as a second sheet attracting device and an air drawing and sheet separating device. Specifically, when the first air blowing nozzle 79*a* of the air blowing device 79 blows air, it is likely that the subsequent sheet SP2 is lifted and floated together with the uppermost sheet SP1. At this time, the second air drawing device 90 draws and attracts the subsequent sheet SP2. By so doing, in the step of the sheet feeding operation illustrated in FIG. 6C, the second air drawing device 90 attracts and, at the same time, positively separates the subsequent sheet SP2 from the uppermost sheet SP1.

The second air drawing device 90 includes an air drawing duct 91 having an air drawing port 91*a*, an air drawing fan that is coupled with the air drawing duct 91, and so forth. In a case in which the second air drawing device 90 is provided as described above, the air drawing duct 91 functions as a regulator to regulate movement of the subsequent sheet SP2 in the sheet conveying direction relative to the uppermost sheet SP1 lifted by the air blowing device 79. The air drawing port 91*a* of the air drawing duct 91 has an end portion 91*b* to function as an opposing portion of the regulator. To be more specific, similar to the opposing portion of the regulating plate 80 in the present embodiment of this disclosure, the air drawing duct 91 includes a first vertical opposing portion, an inclined opposing portion, and a second vertical opposing portion formed in the end portion 91*b* of the air drawing port 91*a*. With this configuration, the air drawing duct 91 functions as the regulating plate 80 according to the present embodiment of this disclosure.

Variation 2.

Figure 10:
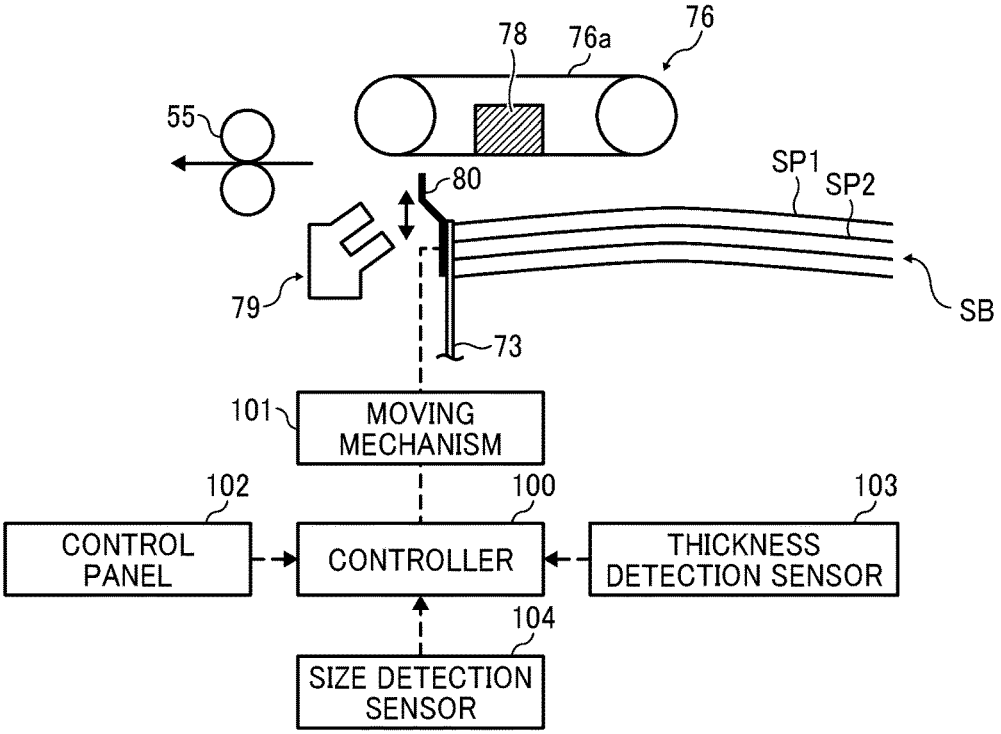
FIG. 10 is a drawing illustrating a main part of the sheet feeding device according to Variation 2.

FIG. 10 is a drawing illustrating a main part of the sheet feeding device 70 according to Variation 2. FIG. 10 is modified based on the sheet feeding operation illustrated in FIG. 6A.

As illustrated in FIG. 10, the sheet feeding device 70 includes a moving mechanism 101 that moves the regulating plate 80 in the vertical direction (upwardly and downwardly) automatically. That is, the position in the vertical direction of the regulating plate 80 (i.e., the regulator) is automatically adjustable. The moving mechanism 101 may employ a known rack and pinion mechanism, for example.

In the above-described configuration of the sheet feeding device 70 in Variation 2, the position in the vertical direction of the regulating plate 80 can be automatically adjusted based on at least one of type, thickness, and size of a sheet SP of the sheet bundle SB loaded on the sheet loader 72. Specifically, as illustrated in FIG. 10, a control panel 102 mounted on an exterior of the apparatus body of the image forming apparatus 1 includes a memory in which information of the sheet SP such as thickness information and size information is inputted and stored. Based on the information, a known thickness detection sensor 103 detects the thickness of the sheet SP and a known size detection sensor 104 detects the size of the sheet SP. Based on the detection results obtained by the known thickness detection sensor 103 and the known size detection sensor 104, a controller 100 determines an appropriate height of the regulating plate 80. Consequently, the controller 100 controls the moving mechanism 101 to adjust the regulating plate 80 to be located at a position in appropriate height.

Similar to the configuration of the sheet feeding device 70 according to the present embodiment of this disclosure, the sheet feeding device 70 according to Variation 2 having the above-described configuration can properly operate the regulating plate 80.

As described above, the sheet feeding device 70 according to the present embodiment of this disclosure includes the first vertical opposing face 80*a* and the inclined opposing face 80*b*. The first vertical opposing face 80*a* functions as an opposing portion disposed facing the regulating plate 80 that functions as a regulator to regulate movement of the uppermost sheet SP1 relative to the subsequent sheet SP2 located below the uppermost sheet SP1 lifted by the air blowing device 79. The first vertical opposing face 80*a* is located at the upper part of the regulating plate 80 and separated from the position of the reference plane 73 toward the downstream side of the sheet conveying direction. The inclined opposing face 80*b* is formed such that an upper end thereof downwardly extends from a lower end of the first vertical opposing face 80*a* and inclined relative to the vertical direction to the sheet conveying direction such that the lower end of the inclined opposing face 80*b* gradually approaches the reference plane 73 in the sheet conveying direction and meets a substantially same position as the reference plane 73.

Accordingly, when the uppermost sheet SP1 is conveyed in the sheet conveying direction in a state in which the uppermost sheet SP1 lifted by air blown by the air blowing device 79 is attracted by the air drawing device 78, the present embodiment of this disclosure can reduce the number of sheet feeding failures caused by the uppermost sheet SP1 hooked with the regulating plate 80 without occurrence of multifeed of the uppermost sheet SP1 and the subsequent sheet SP2.

It is to be noted that the present embodiment of this disclosure is applied to the sheet feeding device 70 provided to the image forming apparatus 1 that performs monochrome image formation. However, this disclosure is not limited thereto. For example, this disclosure can also be applied to a sheet feeding device provided to an image forming apparatus that performs color image formation.

Further, it is to be noted that the present embodiment of this disclosure is applied to the sheet feeding device 70 provided to the image forming apparatus 1 that employs electrophotography. However, this disclosure is not limited thereto. For example, this disclosure can also be applied to a sheet feeding device provided to an image forming apparatus that employs an inkjet method or a stencil printing machine.

Further, it is to be noted that the present embodiment of this disclosure is applied to the sheet feeding device 70 that can hold the large capacity of sheets. However, this disclosure is not limited thereto. For example, this disclosure can also be applied to the first sheet feed tray 12 and the second sheet feed tray 13 both functioning as a sheet feeder, as long as the first sheet feed tray 12 and the second sheet feed tray 13 employs an air drawing method. Further, this disclosure can also be applied to the document conveying unit 10 (the ADF) that functions as a sheet feeder as long as the document conveying unit 10 employs an air drawing method.

Further, when the above-described sheet feeder such as the sheet feeding device 70, the first sheet feed tray 12, the second sheet feed tray 13, and the document conveying unit 10 can achieve the same effect as the effect provided by the configuration(s) in the present embodiment.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeder comprising:

a sheet loader including a wall standing upward at a downstream side of a sheet conveying direction, on which a sheet bundle is loaded;

an air blowing device including a first air blowing body disposed downstream from the sheet loader in the sheet conveying direction, the air blowing device configured to blow air toward the sheet bundle loaded on the sheet loader and lift a sheet over the sheet bundle;

a regulator mounted on the wall of the sheet loader;

a sheet attracting device disposed above the sheet loader, the sheet attracting device configured to attract the sheet lifted over the sheet bundle by the air blowing device; and a sheet conveying device configured to convey the sheet in the sheet conveying direction with the sheet attached thereto by the sheet attracting device, the regulator having an upper end located relatively higher than the wall of the sheet loader and relatively lower than a plane of the sheet conveying device along which the sheet is conveyed in the sheet conveying direction, the regulator including a vertical face separated from the wall of the sheet loader toward a downstream side of the sheet conveying direction and extending in a substantially vertical direction, and an inclined portion downwardly inclined toward the wall of the sheet loader from a lower end of the vertical face.

2. The sheet feeder according to claim 1, wherein the vertical face of the regulator extends upwardly from an upper end of the inclined portion of the regulator, and the regulator further includes another vertical face extending downwardly from a lower end of the inclined portion of the regulator.

3. The sheet feeder according to claim 2, further comprising:

a loader elevation device configured to automatically adjust a vertical position of the sheet by moving the sheet loader upwardly or downwardly in the substantially vertical direction according to a number of sheets loaded on the sheet loader, such that the sheet is located at a predetermined vertical position even though the number of sheets loaded on the sheet loader varies; and a height detection sensor configured to detect the predetermined vertical position of the sheet, wherein the lower end of the inclined portion of the regulator is located at a same vertical position as the predetermined vertical position of the sheet.

4. The sheet feeder according to claim 3, wherein the regulator is mounted on the wall of the sheet loader via screws, and a vertical position of the regulator is manually adjustable by loosening the screws and moving the regulator upwardly or downwardly in the substantially vertical direction along the wall of the sheet loader.

5. The sheet feeder according to claim 3, wherein the sheet attracting device is a first sheet attracting device, and the sheet feeder further comprises:

a second sheet attracting device disposed downstream from the sheet loader in the sheet conveying direction and configured to attract a subsequent sheet located below the sheet lifted by the air blowing device, wherein the second sheet attracting device includes a duct having a drawing port, and the regulator includes the duct.

6. The sheet feeder according to claim 3, wherein the air blowing device further includes a second air blowing body disposed downstream from the sheet loader in the sheet conveying direction and configured to blow air between the sheet and a subsequent sheet so as to separate the subsequent sheet from the sheet.

7. The sheet feeder according to claim 1, further comprising:

a loader elevation device configured to automatically adjust a vertical position of the sheet by moving the sheet loader upwardly or downwardly in the substantially vertical direction according to a number of sheets loaded on the sheet loader, such that the sheet is located at a predetermined vertical position even though the number of sheets loaded on the sheet loader varies; and a height detection sensor configured to detect the predetermined vertical position of the sheet, wherein a lower end of the inclined portion of the regulator is located at a same vertical position as the predetermined vertical position of the sheet.

8. The sheet feeder according to claim 7, wherein the regulator is mounted on the wall of the sheet loader via screws, and a vertical position of the regulator is manually adjustable by loosening the screws and moving the regulator upwardly or downwardly in the substantially vertical direction along the wall of the sheet loader.

9. The sheet feeder according to claim 8, wherein the sheet attracting device is a first sheet attracting device, and the sheet feeder further comprises:

a second sheet attracting device disposed downstream from the sheet loader in the sheet conveying direction and configured to attract a subsequent sheet located below the sheet lifted by the air blowing device, wherein the second sheet attracting device includes a duct having a drawing port, and the regulator includes the duct.

10. The sheet feeder according to claim 8, wherein the air blowing device further includes a second air blowing body disposed downstream from the sheet loader in the sheet conveying direction and configured to blow air between the sheet and a subsequent sheet so as to separate the subsequent sheet from the sheet.

11. The sheet feeder according to claim 1, wherein the regulator is mounted on the wall of the sheet loader via screws, and a vertical position of the regulator is manually adjustable by loosening the screws and moving the regulator upwardly or downwardly in the substantially vertical direction along the wall of the sheet loader.

12. The sheet feeder according to claim 1, further comprising:

at least one sensor configured to detect at least one of a type, a thickness, and a size of the sheet loaded on the sheet loader; and a regulator moving mechanism configured to automatically adjust a vertical position of the regulator by moving the regulator upwardly or downwardly in the substantially vertical direction based on the at least one of the type, the thickness, and the size of the sheet detected by the at least one sensor.

13. The sheet feeder according to claim 1, wherein the sheet attracting device is a first sheet attracting device, and the sheet feeder further comprises:

a second sheet attracting device disposed downstream from the sheet loader in the sheet conveying direction and configured to attract a subsequent sheet located below the sheet lifted by the air blowing device, wherein the second sheet attracting device includes a duct having a drawing port, and the regulator includes the duct.

14. The sheet feeder according to claim 1, wherein the air blowing device further includes a second air blowing body disposed downstream from the sheet loader in the sheet conveying direction and configured to blow air between the sheet and a subsequent sheet so as to separate the subsequent sheet from the sheet.

15. An image forming apparatus, comprising:

the sheet feeder according to claim 1, configured to feed the sheet; and an image forming device configured to form an image on the sheet fed from the sheet feeder.

16. A sheet feeder comprising:

a sheet loader including a wall standing upward at a downstream side of a sheet conveying direction, on which a sheet bundle is loaded;

an air blowing device including a first air blowing body disposed downstream from the sheet loader in the sheet conveying direction, the air blowing device configured to blow air toward the sheet bundle loaded on the sheet loader and lift a sheet over the sheet bundle;

a sheet attracting device disposed above the sheet loader, the sheet attracting device configured to attract the sheet lifted over the sheet bundle by the air blowing device;

a sheet conveying device configured to convey the sheet in the sheet conveying direction with the sheet attached thereto by the sheet attracting device; and a regulator mounted on the wall of the sheet loader, the regulator including a first vertical opposing face forming an upper portion of the regulator, located relatively higher than the wall of the sheet loader and relatively lower than a plane of the sheet conveying device along which the sheet is conveyed in the sheet conveying direction, separated from the wall of the sheet loader by a certain distance toward a downstream side of the sheet conveying direction, and extending upwardly in a substantially vertical direction, an inclined opposing face forming an intermediate portion of the regulator and extending at a downward incline from a lower end of the first vertical opposing face toward the wall of the sheet loader, and a second vertical opposing face forming a lower portion of the regulator, and extending downwardly from a lower end of the inclined opposing face of the regulator along the wall of the sheet loader in the substantially vertical direction.

17. The sheet feeder according to claim 16, wherein the lower end of the inclined opposing face of the regulator is located at a position in a vicinity of an upper end of the wall of the sheet loader.

18. The sheet feeder according to claim 16, further comprising:

at least one sensor configured to detect at least one of a type, a thickness, and a size of the sheet loaded on the sheet loader; and a regulator moving mechanism configured to automatically adjust a vertical position of the regulator by moving the regulator upwardly or downwardly in the substantially vertical direction based on the at least one of the type, the thickness, and the size of the sheet detected by the at least one sensor.

* * * * *